US006601500B2

(12) United States Patent
Lauderbaugh

(10) Patent No.: US 6,601,500 B2
(45) Date of Patent: Aug. 5, 2003

(54) LOW FRICTION MACHINE FOR MANUFACTURING CORRUGATED BOARD

(75) Inventor: David Lauderbaugh, Roswell, GA (US)

(73) Assignee: Corrugated Gear & Services, Inc., Alpharetta, GA (US)

( * ) Notice: Subject to any disclaimer, the term of this patent is extended or adjusted under 35 U.S.C. 154(b) by 68 days.

(21) Appl. No.: 09/925,271

(22) Filed: Aug. 9, 2001

(65) Prior Publication Data

US 2002/0148368 A1 Oct. 17, 2002

Related U.S. Application Data

(60) Provisional application No. 60/283,859, filed on Apr. 13, 2001.

(51) Int. Cl.[7] ..... B05C 1/08; B30B 15/34; B31F 5/00

(52) U.S. Cl. ..... 100/326; 100/106; 100/214; 100/229 R; 156/580; 156/583.1; 156/205; 156/470

(58) Field of Search ..... 493/463, 71, 81, 493/313; 100/229 R, 233, 214, 37, 38, 90, 326, 106; 156/471–473, 580, 583.1, 205, 470

(56) References Cited

U.S. PATENT DOCUMENTS 4,676,079 A * 6/1987 Czauderna ..... 68/242
4,889,580 A * 12/1989 Seki et al. ..... 156/382
5,526,739 A 6/1996 Lauderbaugh et al.
5,562,796 A * 10/1996 Ertel ..... 156/498
5,632,830 A 5/1997 Marschke
5,732,622 A 3/1998 Lauderbaugh
5,853,527 A * 12/1998 Marschke et al. ..... 156/470
5,915,295 A 6/1999 Lauderbaugh
5,916,414 A * 6/1999 Kato et al. ..... 156/578
5,948,197 A 9/1999 Marschke
6,041,840 A * 3/2000 Ogawa ..... 156/382
6,089,296 A * 7/2000 Hess et al. ..... 156/462
6,136,417 A * 10/2000 Ishibuchi et al. ..... 428/182
6,168,963 B1 * 1/2001 Freund et al. ..... 438/26
6,257,866 B1 * 7/2001 Fritz et al. ..... 425/387.1

FOREIGN PATENT DOCUMENTS

EP 0 275 812 B1 * 4/1991 ..... D01G/37/00

* cited by examiner

*Primary Examiner*—Rinaldi I. Rada
*Assistant Examiner*—Brian D Nash
(74) *Attorney, Agent, or Firm*—Michael J. Mehrman; Mehrman Law Office, P.C.

(57) ABSTRACT

A low friction machine for manufacturing corrugated board is described. The machine effectively extends the life expectancy of critical machine components such as the feet used in pressure applicators as well as a conveyor belt by reducing friction. The machine includes a foot operative for applying pressure to the substrate. The foot includes a conduit having a first end and a second end. An actuator attached to the foot and moves the foot between a raised position and a lowered position. The lowered position is proximate the substrate. An air supply connected to the first end of the conduit and supplies air to the foot. A check valve coupled to the second end of the conduit and regulates airflow in the foot. The check valve is opened when the foot is in the lowered position and closed when the foot is in the raised position.

18 Claims, 4 Drawing Sheets

LOW FRICTION MACHINE FOR MANUFACTURING CORRUGATED BOARD

CROSS REFERENCE TO RELATED APPLICATIONS

This patent application claims priority to commonly owned U.S. Provisional Patent Application Serial No. 60/283,859 filed Apr. 13, 2001, and also relates to U.S. Pat. No. 5,915,295, which is incorporated herein by reference.

TECHNICAL FIELD

The present invention relates generally to the field of corrugated boards, and more particularly, to a low friction machine for manufacturing corrugated board by emitting bursts of air from pressure applicator.

BACKGROUND OF THE INVENTION

Manufacturing corrugated board generally involves creating corrugations or ridges in a median. Positioning the corrugated median between flat liners can form a board of desired thickness. An adhesive between the median layer and substantially flat liner layers secures the median to the liners. Typically, this positioning involves placing the board along a raceway of an assembly line. The assembly line often includes a hotplate section, cooling section, and scoring section.

The hotplate section includes a heat source, typically a series of steam chests that remove moisture and set the adhesive by heating the board. A pressure applicator presses the board against the steam chest to ensure adhesion across the entire width of the board and prevent blisters from forming in the board. Because repeated pressure on the steam chests can cause sagging in the middle, some corrugated board machines use multi-foot pressure applicators that apply variable pressure across the width of a steam chest.

Typically, a conveyor belt in the hotplate section propels the board along the assembly line. The board is typically positioned between the steam chests and the conveyor belt. Positioning the pressure applicators above the conveyor belt can cause direct contact between them and the conveyor belt. Consequently, the conveyor belt translates the pressure from the pressure applicators to the board. Thus, the sliding contact between the conveyor belt and the pressure applicators creates considerable friction.

The resulting friction between the pressure applicators and the conveyor belt causes considerable wear to both the feet and the belt. These parts, which are quite expensive and difficult to replace, therefore warrant frequent replacement. Worse yet, replacing these parts is a major maintenance event that results in shutting-down the entire assembly for an extended period. This is expensive, not only in terms of the cost of the parts, but also in terms of down time. There is, therefore, a need to maximize the life of the pressure applicators and the conveyor belt.

Previous solutions attempted to minimize friction between the belt and pressure applicators in a variety of ways. One solution added a low-friction coating, such as polished steel, TEFLON, or ceramic coatings to the pressure-applying feet. While use of this coating reduces the wear to both the feet and the conveyor belt, it does not solve the problem. Eventually the coatings wear off and the friction problem reoccurs. Other solutions include covering the pressure applicators with a low friction material. Like the coating solution, the covers eventually wear off and the pressure applicators have to be replaced.

Another conventional solution removes the conveyor belt from the hotplate section of the assembly line. Some other conveying mechanisms, such as a pulling section located downstream from the hotplate section, can propel the board through the assembly line. Although wear to the conveyor belt is eliminated, there are a number of problems with this approach. First, the pressure applicators still wear. Second, it may be desirable to change the thickness of the board, by adding or removing adhering layers, while the board is moving through the assembly line. When a layer is added to the moving surface without the conveyor belt to span between adjacent feet in the direction of machine flow, the upstream edges of the feet can snag on the leading edge of the added layer. This destroys the board and can result in a complete shutdown of the assembly line to restart the line for a board of desired thickness.

Despite the development in the area machines for manufacturing corrugated boards, conventional solutions fail to provide a long-term, feasible, and cost effective solution for substantially reducing friction. Thus, a need still exists for a long lasting machine and method for manufacturing corrugated board that avoids friction related problems.

SUMMARY OF THE INVENTION

The present invention meets the needs described above in a low friction machine for manufacturing corrugated board. The invention effectively extends the life expectancy of critical machine components such as the feet used in pressure applicators as well as a conveyor belt by reducing friction. Using a check valve in the pressure applicator, the present invention expels a burst of air that hinders feet from directly contacting the sliding corrugated board. Because considerable friction results from the direct contact between the pressure applicators and sliding board, avoiding this direct contact substantially reduces friction and increases the longevity of the pressure applicators.

In another advantage, the invention allows precise control on the amount of pressure applied to the corrugated board by individual pressure applicators. As a result, operators can vary the pressure applied to the board depending on the location of the pressure applicators. For example, an operator may increase the pressure applied by pressure applicators located along the centerline of the corrugated board while decreasing the pressure exerted by pressure applicators located along the edges of the board. Because a controller that make these adjustments remotely, avoiding manual adjustments saves considerable time.

Generally described, the invention is a machine for applying pressure to a substrate positioned on a hard surface. The machine includes a foot operative for applying pressure to the substrate. The foot includes a conduit having a first end and a second end. An actuator attached to the foot and moves the foot between a raised position and a lowered position. The lowered position is proximate the substrate. An air supply connected to the first end of the conduit and supplies air to the foot. A check valve coupled to the second end of the conduit and regulates airflow in the foot. The check valve is opened when the foot is in the lowered position and closed when the foot is in the raised position.

In another embodiment, the invention is a machine for applying pressure to a moving substrate positioned on a heated surface. The machine includes a row of pressure applicators. Each pressure applicator includes a foot operative for applying pressure to the moving substrate. The foot includes a conduit having a first end and a second end. An actuator attached to the foot and moves the foot between a raised position and a lowered position. The lowered position is proximate to the moving substrate. An air supply connected to the first end of the conduit and supplies air to the foot. A check valve coupled to the second end of the conduit and regulates the airflow in the foot. The check valve is opened when the foot is in the lowered position and closed when the foot is in the raised position.

The invention includes corrugated board manufactured by the process of applying pressure to the corrugated board. The process includes applying pressure to the corrugated board with a foot. The foot includes a conduit having a first end and a second end. The process also includes moving the foot between a raised position and a lowered position with an actuator attached to the foot, wherein the lowered position is proximate to the corrugated board. The process also includes supplying air to the foot with an air supply connected to the first end of the conduit. Another step includes regulating airflow in the foot with a check valve coupled to the second end of the conduit, wherein the check valve is opened when the foot is in the lowered position and closed when the foot is in the raised position.

In view of the foregoing, it will be appreciated that the machine for manufacturing corrugated board avoids the drawbacks of prior systems. The specific techniques and structures employed by the invention to improve over the drawbacks of the prior systems and accomplish the advantages described above will become apparent from the following detailed description of the embodiments of the invention and the appended drawings and claims.

DETAILED DESCRIPTION OF THE EMBODIMENTS

Figure 1:
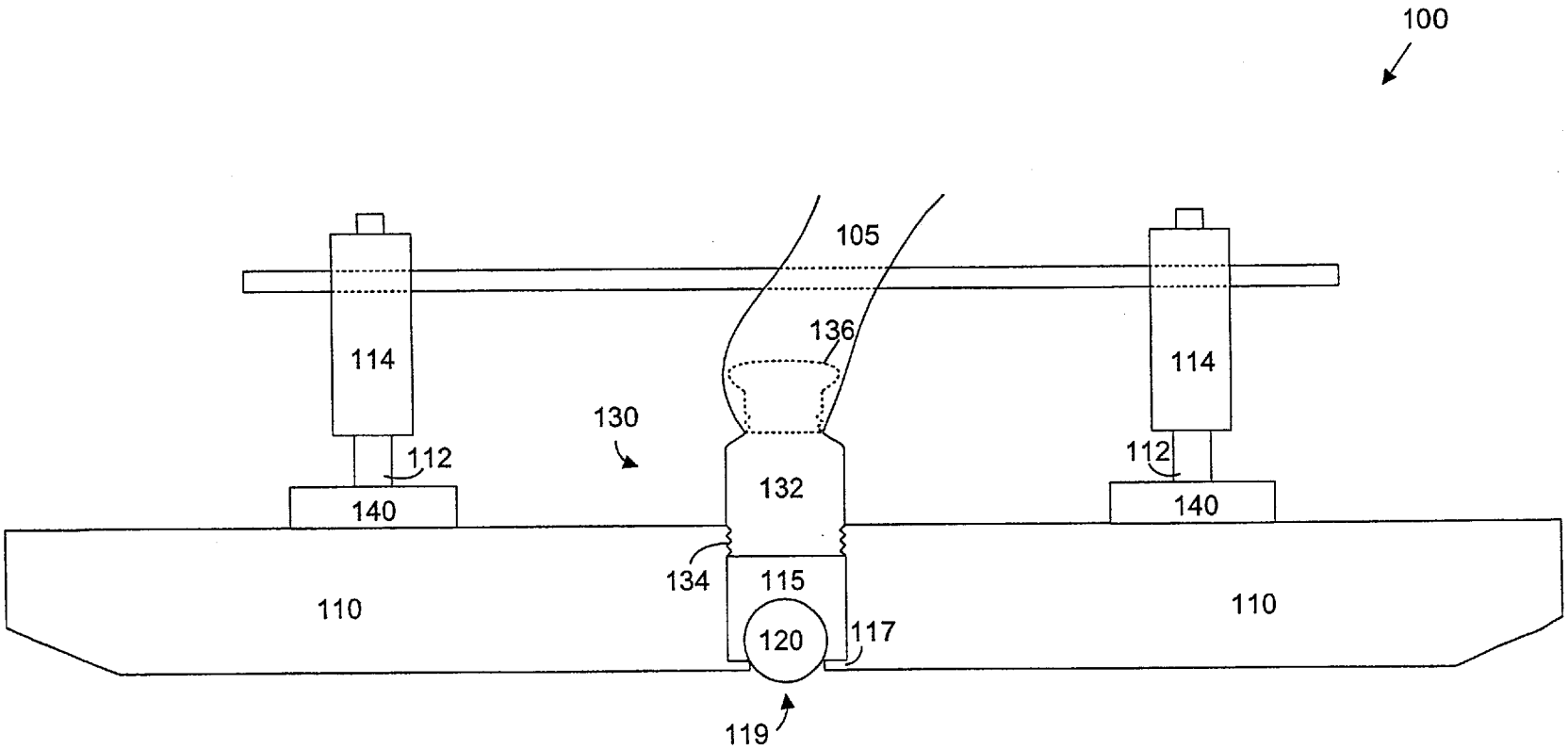
FIG. 1 is a cross sectional view of a pressure applicator that includes a removable weight.

The present invention may be embodied in a low friction machine that reduces friction between the pressure applicators and the moving board by using an air cushion. The air gap created by the air cushion could be approximately ⅜ inches, but this dimension could vary depending on the dimensions of the selected components. In creating the air cushion, the invention delivers a burst of pressurized air, or other appropriate pressurized gas, between the pressure applicator and the conveyor belt. Each pressure applicator includes a foot, ball and check valve. The foot has a flat bottom surface proximate to the top surface of the moving board and the air cushion remains between these two surfaces.

Each foot is essentially a metal plate, preferably a steel plate, with chamfered edges. The chamfered edges reduce interference, such as snagging, of the feet with the board surface as it moves through the machine. Two runners are attached on the top of each plate for added rigidity and to provide a mounting point for rods that allow up and down movement of the plate. These runners are preferably steel and welded to the plate in the machine direction at the outer edges of the plate.

An opening in the center of the foot receives air from a nipple attached to the plate. The opening in the bottom of the plate expels air, thereby creating the air cushion as the expelled air rushes out the opening and disperses under the plate. The dispersing air opposes the weight of the foot, thereby maintaining the bottom surface of the foot away from the surface of the moving board. Since the weight of the foot will not further compress the air under the foot at the given air pressure, the air cushion transfers the weight of the foot to the moving board. Thus, because the foot surface does not contact the board surface, the friction resulting at the board surface due to the weight of the foot that is normal to the board surface is negligible.

The invention allows regulation of the air pressure to match the weight of each individual foot. If the pressure is too low, the air cushion will collapse under the weight of the foot. If the pressure is too high, the foot will tend to rise higher than the desired ⅜ inch gap. The invention regulates the air pressure between individual feet by including a needle valve inline with a supply line to a particular foot. By adjusting each needle valve manually or remotely, a controller can achieve a desired air gap distance. For instance, if the weight of a foot is increased, the valve may be adjusted accordingly so that the air supply system delivers more pressure, thus maintaining the air gap at a desired distance.

The air pressure regulation system also may use sensors for sensing parameters such as board surface temperature, board wetness, overall system air pressure, and board thickness. The air pressure among the feet may be adjusted automatically based on input from these sensors functioning in a negative feedback mode with a computer. Input signals from the sensors are fed into a computer which executes an algorithm to determine whether the air pressure needs to be adjusted based on the signals received from the sensors. If the computer determines that adjustment to the air pressure is needed, the needle valves may be adjusted automatically with an electrical signal generated by the computer that is transmitted to an actuator attached to each valve. The computer may adjust each individual valve associated with each pressure-applying foot or it may adjust the overall supply valve.

Each foot is suspended from a frame that is preferably formed of a steel channel. Each channel frame suspends a plurality of feet in a row. The invention allows the foot freedom of movement in the up and down direction while restricting movement in the plane parallel to the board surface. This is accomplished through the use of four rods, one at each corner of the foot. The rods, attached to the foot at the runners that are on either side of the foot, extend through holes in the channel frame. On the topside of the channel frame, a bushing is placed over each hole having an inner diameter equal to the outer diameter of the rod. The rod passes through the hole in the frame and on through the cylindrical hole in the bushing. Thus, the foot is located with respect to a plane parallel to the board surface but is free to move up and down. The rods may be cross drilled at a distance about one inch below the lowest portion of the rod that is exposed above the bushing when the foot is in the ⅜ inches above the board surface operation position. A pin can then be inserted through the rod to suspend the foot about 1⅜ inch above the surface of the board in case a board narrower than the full width of the row of feet is desired.

In addition to the foot, each pressure applicator includes a check valve associated with each foot to prevent the gap from widening more than the desired dimension. The check valve may be a commercially available item or a custom made item. The check valve consists of a steel ball inside a cylindrical bore. The valve is attached to the top of the foot such that the cylindrical inner bore is vertical, allowing the ball to travel up and down inside the bore. The foot is machined so that part of the ball extends through an opening in the foot, the opening being circular and of radius slightly smaller than the radius of the ball. The preferred radius of the opening in the foot is 31/64 inch with a depth of approximately 1/16 inch. Consequently, the opening in the foot is countersunk from the top because the plate material of the foot is approximately 7/8 inch thick. Thus, the countersunk portion has a depth of approximately 13/16 inch. Additionally, if a check valve is threaded at the bottom, the countersunk portion of the foot may be larger and threaded to accept the threads of the check valve. This would result in an essentially airtight connection of the check valve to the foot.

The preferred check valve has a 3/4 inch outer diameter and a 17/32 inch inner bore radius to provide 1/32 clearance for the steel ball. A check valve of these dimensions may be commercially available or may be fabricated. For instance, a galvanized steel pipe reducer that provides a transition from a 1/2 inch outer diameter pipe to a 1/4 inch tube could be used for the valve body and a 1/2 inch steel ball could be used as the check ball. The pipe reducer can function as a nipple for receiving air at the small diameter opening from a supply hose and the large diameter portion functions as the valve body.

The dimensions of the valve are selected to achieve a predetermined air gap between the bottom surface of the cushion and the top surface of the board moving through the machine. Where the opening in the foot transitions from the radius of 3/5 inch to 31/64 inch, a lip is formed for the ball to seal against. If the ball is allowed to contact the foot at this sealing surface, air may not pass through the valve. When the ball is not in contact with the lip, air may pass through the valve. When the bottom of the foot is near the top surface of the moving board, the ball contacts the top of the moving board and the weight of the foot moves the foot downward. Since the ball is stationary with respect to the falling foot, air begins to flow between the ball and the foot at the sealing surface. When air begins to flow, the pressure builds below the foot and stems the movement of the foot. Thus, the air cushion is formed. If the air pressure causes the foot to rise a distance greater than the amount the ball extends past the bottom surface of the foot, the ball contacts the sealing surface and checks the flow of air, allowing the foot to begin to fall again. Thus, in addition to the air pressure and the weight of the foot, the check valve and the dimensions of its components determine the distance that the foot rides above the moving board surface.

The invention also selectively regulates the weight exerted by individual pressure applicators. Specifically, the invention includes individual weights surrounding the rods before the rods are placed through the frame and bushings. The weights are preferably circular discs with a hole in the center of diameter substantially equal to the outer diameter of the rod. Consequently, the weight of a particular foot can change to accommodate manufactured boards of varying thickness. For example, thicker board may need more pressure from the feet and thus heavier weights. In addition, weights can be added above the nipple by using spindles welded to the foot for placing the stacks of weights. These spindles may be cylindrical rods of similar diameter to the guide rods, but of shorter length so as not to interfere with the frame channel when the foot is in a raised position.

Referring now to the drawings, in which like numerals indicate like elements, FIG. 1 is a cross sectional view of a pressure applicator, according to the present invention that includes a removable weight. The pressure applicator 100 can mount to an individual frame in a machine for manufacturing corrugated board. A hose 105 receives pressurized gas from an air supply network and supplies the air to the pressure applicator 100. An air pressure regulator, needle valve, and programmable logic controller can regulate the distribution of the pressurized air through the pressure applicator. While pressurized air is described, other types of pressurized gases may also be suitable such as carbon dioxide, oxygen, or hydrogen.

Each pressure applicator 100 includes a foot 110 that exerts the downward force used in curing the adhesive and removing moisture between the layers of the corrugated board. Rods 112 positioned at each corner of the foot 110 connect the pressure applicator 100 to the machine and enable lifting of the foot 110. A cylinder 114 connects to each rod 112 and regulates movement of the rod 112. This cylinder can be any type of conventional cylinder. In forming the foot 110, the material could be steel, iron, titanium, or some other suitable material. The dimensions of the foot 110 could be approximately 7/8 inches thick with a square area of approximately 144 inches$^2$.

The foot 110 includes a channel 115, a lip 117, and an airway 119. In forming the channel 115, the foot 110 is bored and then countersunk from the top. The countersink partially extends through the foot 110 and enables formation of the lip 117. As the pressurized gas enters the foot 110 through the hose 105, this gas collects in the channel 115. Including the airway 119 in the center of the foot 110 enables uniform distribution of the gas collected in the channel 119. The dimensions of the airway 119 could be between approximately 31/64 inches and approximately 15/32 inches.

In addition to the foot 110, the pressure applicator 100 includes a check valve 130. The check valve 130 includes a conduit, or nipple, 132. The nipple 132 is a cylindrically shaped metal device that connects to and receives air from the hose 105. The nipple 132 has a first opening associated with threads 134. The foot 110 includes complimentary threads that receive the threads 134 and secure the nipple 132. A lip on the nipple 130 can help secure the hose 105. Securing a clamp around the lip on the nipple 132 positively retains the hose 105 and provides a reliable seal. As the air supply network sends air through the hose 105, this air collects in the channel 115 with minimal leakage. The check valve 130 also includes a plug 120, or ball with a diameter of approximately 1/2 inches that can move freely about the channel 115. By sizing the ball 120 with a radius smaller than the radius of the airway 119, the ball 120 seals the airway when resting on the lip 117.

The pressure applicator 100 also includes removable weights 140 that surround the rods 112. These weights can selectively increase the downward pressure exerted by the foot 110 on a corrugated board, as needed. Typically, thicker boards as well as portions of the board along the centerline need more downward pressure. Because a typical machine that manufactures corrugated board uses numerous pressure applicators 100, operators can adjust for board thickness or board position by simply adding or removing weights. Hence, using the weights 140 enable use of the pressure applicator 100 with boards of varying thickness and widths. Depending on the desired downward pressure, operators could achieve this pressure by stacking multiple weights. The shape of the weights 140 could be rectangular, triangular, disc shaped, or any other suitable shape. In addition, a washer and a clamp may be attached around each rod 112 that prevents the weights 140 from vibrating.

Though not shown, the foot 110 could also include an extension block. This block could supplement the material of the foot 110 and more effectively secure the nipple 132. Typically, the depth of the foot 110 cannot include both the channel 115 and proper thread length for securing the nipple 132. Thus, using an extension block enables effective securing of nipple 132. The extension block can include a cylindrical hole bored through the center, in which complimentary threads 134 for receiving the nipple 130. Alternately, the countersunk portion may be threaded to partially accept the threads 8 of the nipple 30.

The pressure applicator 100 can also include cross-drilled holes, not shown, in the rod 112. These holes can provide a convenient way of retaining some pressure applicators 100 in a raised position from the corrugated board above the corrugated board. For example, manufacturing thinner boards may warrant suspending some pressure applicators. Depending on the weight of the particular pressure applicator 100, maintenance personnel may either manually raise it or use a portable jacking device. When a foot has been raised, a pin may be inserted through the cross drilled hole for retaining the foot 110 in a raised position. Thus, the invention simply, inexpensively, and conveniently produces corrugated boards of varying thickness. If even more refinement of board thickness is desired, the present invention can be combined with the ball screw mechanism as described in U.S. Pat. No. 5,732,622 issued to David Lauderbaugh on Mar. 32, 1998 which was previously incorporated by reference.

Figure 2:
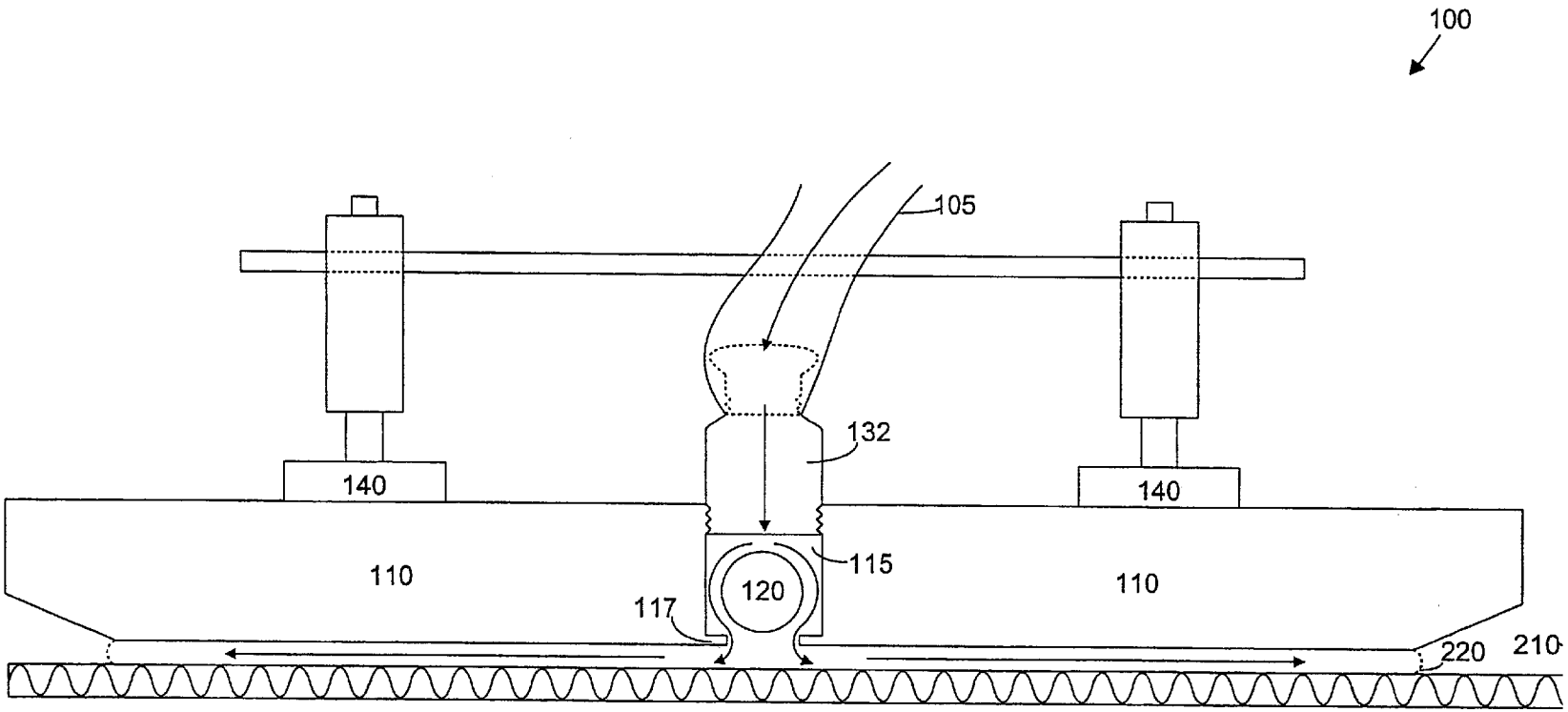
FIG. 2 is a partial cross-sectional view of a machine illustrating the creation of an air cushion by using pressure applicator of FIG. 1.

Turning now to FIG. 2, FIG. 2 is a partial, cross-sectional view of a machine 200 illustrating the creation of an air cushion by using the pressure applicator 100. As indicated by the arrow, pressurized gas flows through the hose 105 and nipple 132 to the channel 115. The gas exerts a downward force on the ball 120. As more clearly seen in FIG. 1, the ball 120 extends through the airway 119 as it rests on the lip 117. As the foot 110 moves toward the corrugated board 210 of FIG. 2, the ball 120 contacts this board. Continual downward movement of the pressure applicator 100 removes the ball 120 from the lip 117. Pressurized air in the channel 115 now escapes through the airway 119 as indicated by the arrows.

As the air escapes, it forms the air cushion 220. The dimensions of the air cushion can vary to accomplish design constraints, such as a desired minimum distance between the foot 110 and the corrugated board 210. If the upward pressure exerted by the air cushion 220 against the foot 110 equals the opposing pressure exerted by the foot 110, the air cushion 220 ceases the downward movement of the foot 110. In addition, this air cushion transfers some of the downward force to the corrugated board 210. Because the air cushion 220 transfers this force, the foot 110 does not directly contact the board 210, which reduces friction. While FIG. 2 illustrates a beltless machine, the pressure applicator 100 can also be used in machines that use conveyor belts.

Figure 3A:
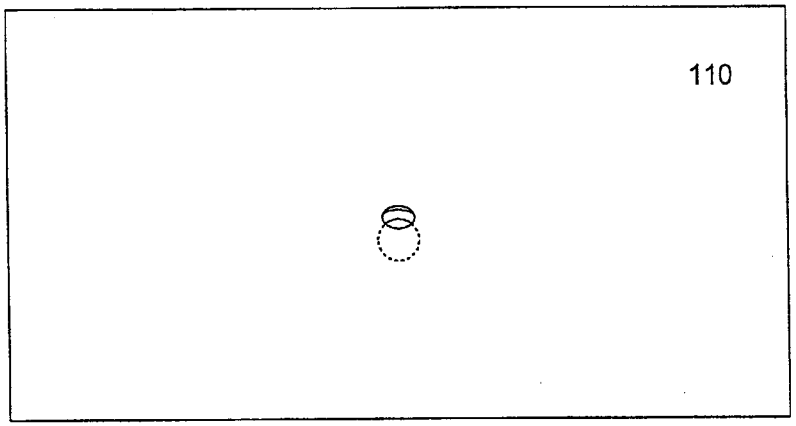
FIG. 3A is a bottom view of the pressure applicator of FIG. 2 illustrating the position of the airway.
Figure 3B:
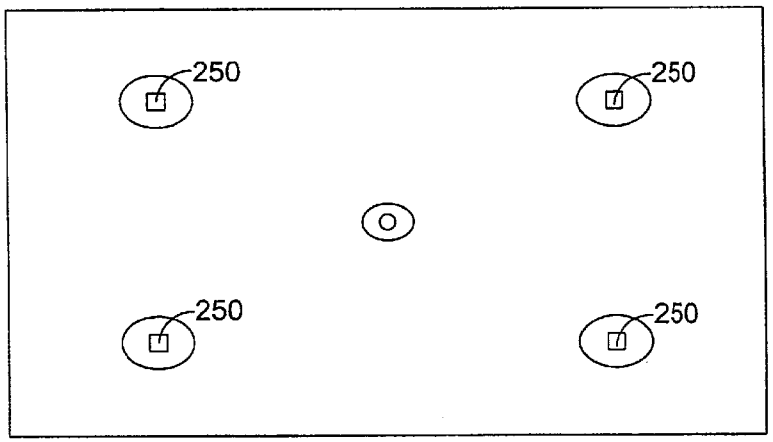
FIG. 3B is a top view of the pressure applicator of FIG. 2.

FIGS. 3A and 3B respectively illustrate bottom and top views of the pressure applicator 100. As illustrated in FIG. 3A, the airway 119 is positioned in the center of the foot 110. This positioning creates the uniform air cushion 220 described with reference to FIG. 2. FIG. 3B illustrates the four air cylinders 114 used in actuating the rods 112. Synchronization of these cylinders enables even lifting of the foot 110.

Figure 4:
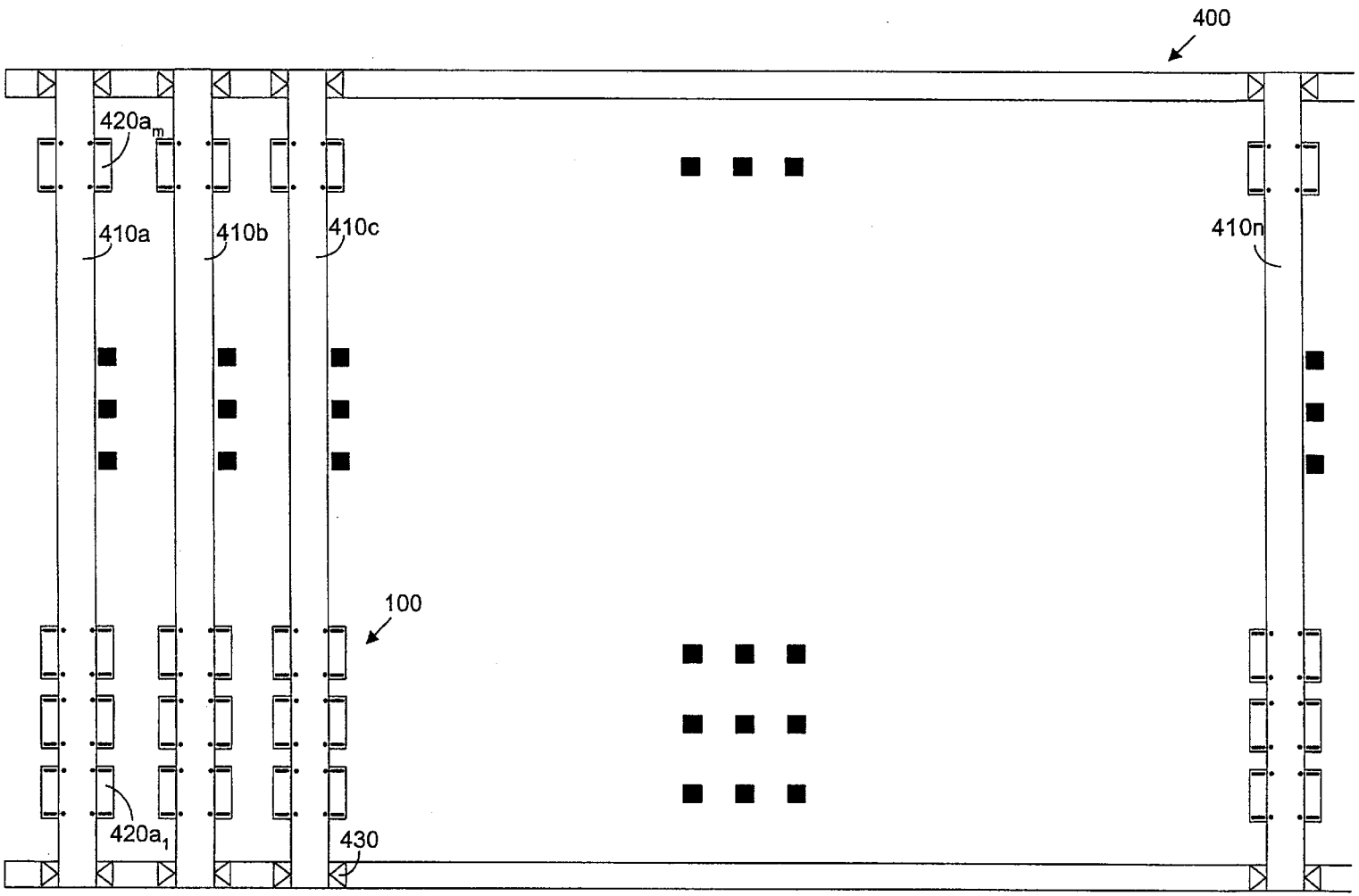
FIG. 4 is a top view of the machine of FIG. 2 illustrating numerous pressure applicators arranged in a grid configuration.

FIG. 4 is a top view of a machine 400 for manufacturing corrugated board that includes numerous pressure applicators 100 arranged in a grid configuration. Each row of pressure applicators in the cross machine direction is connected to a row frame 410*a*–410*n* that extends in the cross-machine direction. For example, the row including the pressure applicators 420$a_1$–420$a_m$ connects to the frame 410*a*. Though labeled as pressure applicators 420$a_1$–420$a_m$ for clarity, each of these pressure applicators function substantially similar to the pressure applicator 100 described with reference to FIG. 1. Row frames 410*b*–410*n* function similarly to row frame 410*a* for associated pressure applicators 100. The brackets 430 rigidly connect the row frames 420*a*–420*n* to machine frame 430 or another suitable foundation. Consequently, the machine 400 produces corrugated board with minimal friction by using a grid of pressure applicators 100. Moreover, this grid configuration allows independent suspension of one or more pressure applicators 100 to accommodate various types of boards.

In view of the foregoing, it will be appreciated that the present invention provides a friction machine that effectively reduces friction between the feet and the corrugated board. In addition, the invention effectively adapts to boards of varying thickness using removable weights and suspended feet. Finally, the invention's universality enables use in both beltless machines and machines that use conveyor belts. It should be understood that the foregoing relates only to the exemplary embodiments of the present invention, and that numerous changes may be made therein without departing from the spirit and scope of the invention as defined by the following claims.

The invention claimed is:

1. A machine for applying pressure to a substrate traveling adjacent to a surface, the machine comprising:

a foot operative for applying pressure to the substrate, wherein the foot includes a conduit through the foot having a first end and a second end;

an actuator operatively coupled to the foot and configured for moving the foot between a raised position and a lowered position, wherein the lowered position is proximate the substrate;

an air supply operatively connected to the first end of the conduit and operative for supplying air to the conduit through the foot; and a check valve located within the conduit and operative for regulating airflow through the foot, wherein the check valve is opened when the foot is in the lowered position and closed when the foot is in the raised position.

2. The machine of claim 1 wherein the check valve includes an inwardly facing lip proximate to the second end of the conduit defining a channel and a plug for selectively blocking the channel.

3. The machine of claim 2 wherein the plug seals the channel under air pressure provided by the air supply when the foot is moved to the raised position.

4. The machine of claim 3 wherein the plug unseals the channel under pressure supplied by the actuator when the foot is moved to the lowered position.

5. The machine of claim 4 wherein the plug comprises a ball.

6. The machine of claim 1 further comprising a removable weight positioned on the foot and provided for increasing the pressure exerted by the foot on the substrate.

7. The machine of claim 1 wherein the substrate comprises corrugated board.

8. The machine of claim 1 wherein the machine comprises a beltless hold-down section of a machine for manufacturing corrugated board.

9. A machine for applying pressure to a moving substrate traveling adjacent to a heated surface, the machine comprising:

a row of pressure applicators, wherein each pressure applicator includes a foot operative for applying pressure to the moving substrate, wherein the foot includes a conduit through the foot having a first end and a second end;

an actuator operatively coupled to the foot and configured for moving the foot between a raised position and lowered position, wherein the lowered position is proximate to the moving substrate;

an air supply operatively connected to the first end of the conduit and operative for supplying air to the conduit through the foot; and a check valve located within the conduit and operative for regulating airflow through the foot, wherein the check valve is opened when the foot is in the lowered position and closed when the foot is in the raised position.

10. The machine of claim 9 wherein the check valve includes an inwardly facing lip proximate to the second end of the conduit defining a channel and a plug for selectively blocking the channel.

11. The machine of claim 10 wherein the plug seals the channel under air pressure provided by the air supply when the foot is moved to the raised position.

12. The machine of claim 11 wherein the plug unseals the channel under pressure supplied by the actuator when the foot is moved to the lowered position.

13. The machine of claim 12 wherein the moving surface comprises corrugated board.

14. A machine for applying pressure to a corrugated board traveling in a machine direction adjacent to a heated surface, the machine comprising:

a first plurality of pressure applicators along the machine direction;

a second plurality of pressure applicators along a cross machine direction that is transverse to the machine direction, wherein, each of the pressure applicators include a foot operative for applying pressure to the corrugated board, wherein the foot includes a conduit through the foot having a first end and a second end;

an actuator operatively coupled to the foot and configured for moving the foot between a raised position and a lowered position, wherein the lowered position is proximate to the corrugated board;

an air supply operatively connected to the first end of the conduit and operative for supplying air to the conduit through the foot; and a check valve located within the conduit and operative for regulating airflow through the foot, wherein the check valve is opened when the foot is in the lowered position and closed when the foot is in the raised position.

15. The machine of claim 14 wherein the check valve includes an inwardly facing lip proximate to the second end of the conduit defining a channel, and a plug for selectively blocking the channel.

16. The machine of claim 15 wherein the plug seals the channel under air pressure provided by the air supply when the foot is moved to the raised position.

17. The machine of claim 14 wherein the plug unseals the channel under pressure supplied by the actuator when the foot is moved to the lowered position.

18. The machine of claim 14 wherein the machine comprises a beltless hold-down section of a machine for manufacturing corrugated board.

* * * * *